United States Patent [19]

Mendenhall

[11] Patent Number: 4,481,039

[45] Date of Patent: Nov. 6, 1984

[54] METHOD FOR RECYCLING ASPHALTIC CONCRETE

[76] Inventor: Robert L. Mendenhall, 1770 Industrial Rd., Las Vegas, Nev. 89102

[21] Appl. No.: 293,283

[22] Filed: Aug. 17, 1981

[51] Int. Cl.[3] ..... B28C 5/46; C08L 95/00

[52] U.S. Cl. ..... 106/281 R; 366/4; 366/25

[58] Field of Search ..... 106/281; 366/4, 25

[56] References Cited

U.S. PATENT DOCUMENTS

| | | | |
|---|---|---|---|
| 1,774,649 | 9/1930 | Hepburn et al. | 366/7 |
| 3,614,071 | 10/1971 | Brock | 366/4 |
| 3,845,941 | 11/1974 | Mendenhall | 366/24 |
| 3,999,743 | 12/1976 | Mendenhall | 106/281 R |
| 4,075,710 | 2/1978 | Jakob | 366/25 |
| 4,147,436 | 4/1979 | Garbelman | 106/281 R |
| 4,182,631 | 1/1980 | Mendenhall | 106/281 R |
| 4,189,238 | 2/1980 | Mendenhall | 106/281 R |
| 4,215,941 | 8/1980 | Mendenhall | 366/25 |
| 4,309,113 | 1/1982 | Mendenhall | 366/4 |
| 4,318,619 | 3/1982 | Schlarman | 366/4 |
| 4,332,478 | 6/1982 | Binz | 366/4 |

OTHER PUBLICATIONS

NAPA Action News, Jul. 16, 1976.

*Primary Examiner*—Theodore Morris
*Attorney, Agent, or Firm*—Seiler, Quirk & Tratos

[57] ABSTRACT

An improved process for recycling asphaltic concrete comprises introducing asphaltic concrete particles at one end of an elongated rotating drum while supplying flame and hot gases of combustion to the drum at the opposite end, and introducing virgin aggregate into the drum intermediate the two ends. The asphaltic concrete is heated as it travels along a portion of the length of the drum and is recovered just prior to reaching the position along the drum length at which the aggregate is introduced. The aggregate is heated as it travels toward the end of the drum at which the flame and hot gases are introduced. Heated aggregate may be returned to the drum for further heating, and may be directed to the opposite drum end and mixed with the asphaltic concrete in a section of the drum.

21 Claims, 1 Drawing Figure

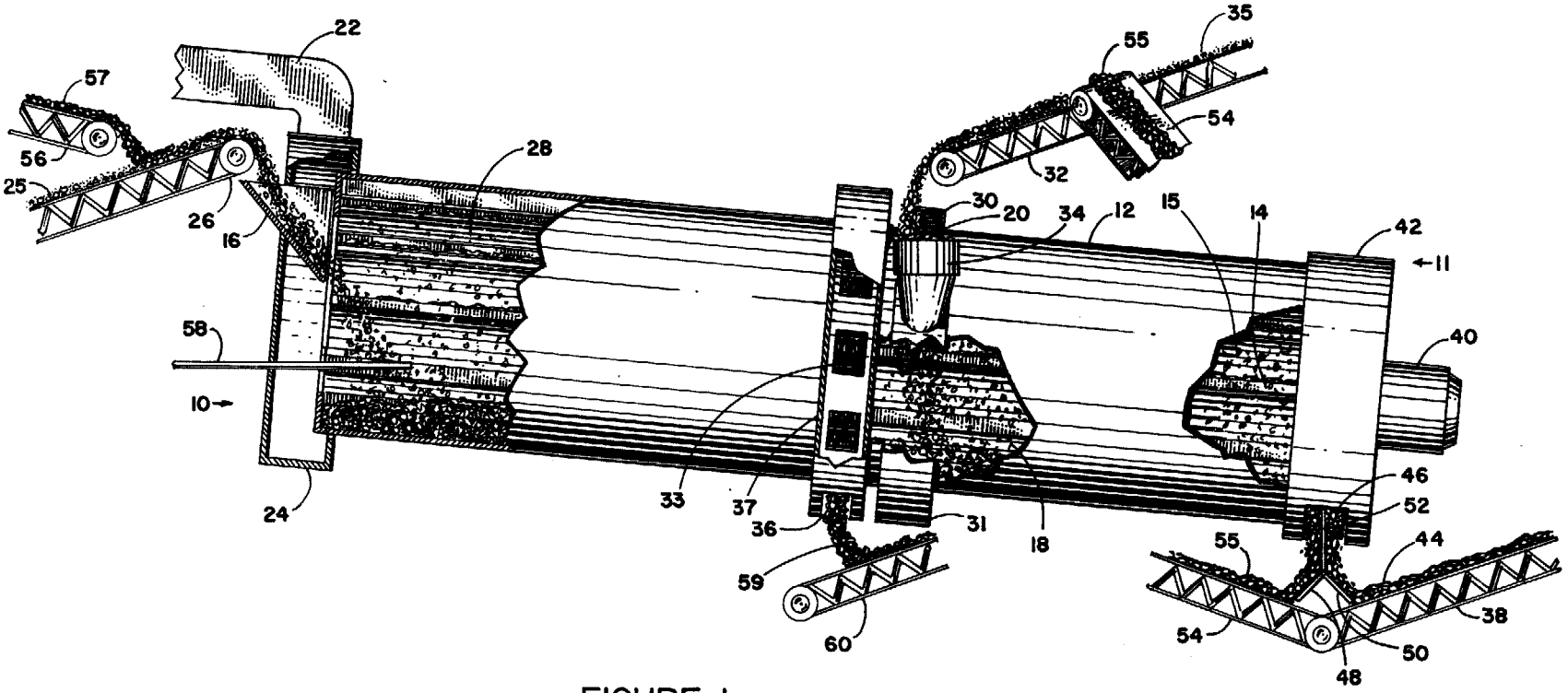
FIGURE I.

METHOD FOR RECYCLING ASPHALTIC CONCRETE

BACKGROUND OF THE INVENTION

Various methods and apparatus have been proposed for recycling asphaltic concrete in an elongated drum of a drum dryer type. Such apparatus and processes have been disclosed, for example, in my U.S. Pat. Nos. 4,177,080 and 4,215,941. In those inventions, virgin aggregate is introduced at one end of the drum and directly exposed to flame and hot gases of combustion from a burner at that same end, while downstream, used asphaltic concrete particles are introduced in an intermediate section of the drum between the burner and the opposite output end at which product is recovered. The aggregate is heated in the first portion of the drum adjacent the burner and is then mixed with the asphaltic concrete in the second portion of the drum adjacent the opposite output end, where the mixture of the heated aggregate and asphaltic concrete are recovered.

In the present invention, an elongated dryer drum type apparatus is provided with means for supplying composition intermediate the two opposite drum ends, but is also provided with a means for recovering composition intermediate the drum ends. Because of the structure of the apparatus, and the method in which it is used, there is provision for substantially heating and super-heating the virgin aggregate in the drum without danger of burning asphaltic concrete, which is heated in a section of the drum upstream away from the end into which flame and hot gases of combustion are introduced. Accordingly, the apparatus and methiod of the present invention offer a further alternative of recycling asphaltic concrete from those known heretofore.

BRIEF DESCRIPTION OF THE DRAWING

The drawing illustrates the apparatus of the invention, partially cutaway, and illustrating the process according to the invention.

DETAILED DESCRIPTION OF THE INVENTION

The drum 12 is substantially hollow along its length and is provided with lifters 14 extending along the drum interior for lifting the composition particles within the drum as the drum is rotated. The drum is also provided with means for rotating the drum, not shown, as is well understood by those skilled in the art. As the drum is rotated, the particles are alternately lifted and dropped by the lifters. As the particles fall gravitationally within the drum interior, they are exposed to the hot gases of combustion so that they become gradually heated as they travel along the drum length or a portion thereof. The drum is tilted to the desired extent from horizontal so that the composition particles are gradually drawn from left to right as the apparatus is viewed in the drawing. The specific lifter design may be selected to achieve the desired extent of composition lift during drum rotation, and different lifters may be used in different sections of the drum depending on the speed of drum rotation, as well as the different temperature zones and composition particles being treated in those zones, as will be understood by those skilled in the art.

At one end 11 of the drum is burner 40 for supplying flame and hot gases of combustion into the drum, which are directed toward the opposite drum end 10. A stationary cover 42 closes the open end of the drum and is provided with a port 46 for recovering composition. At the opposite end 10 of the drum is a cover 24 to which may be secured exhaust gas venting duct 22 through which the exhaust gases from within the drum are directed to suitable dust collectors, filtration apparatus, scrubbers, and the like, if desired prior to being vented to atmosphere.

Composition is introduced at or near the end 10 of the apparatus, opposite burner 40, via chute 16. Means for directing composition to the chute conveniently include a conveyor 26, or other means for feeding the composition into the chute. The apparatus is also provided with a means for supplying composition to the drum interior between the two ends of the drum. Thus, the apparatus is provided with a split feed means whereby composition is introduced at or near the end of the drum opposite the burner, and another means for introducing composition located along the drum length between the ends, conveniently or advantageously near the center of the drum. The intermediate feed means shown includes a hopper 34 for supplying the composition into a stationary trough 31. A plurality of ports 20 are spaced around the drum surface, the ports opening into the drum interior. A scoop 30 is secured to the drum exterior overlying each of the ports 20. The scoops pick up composition in the stationary trough 31 as the drum is rotated and composition particles picked up by the scoop are directed into the drum interior by falling gravitationally through the ports into the drum as shown. The size and shape of stationary trough 31 should be such as to allow the scoops to pass without resistance and pick up the composition particles introduced into the trough via hopper 34. Composition is supplied to the hopper by a conveyor 32 or other means, such as a bucket elevator, or the like. Further features of such composition feed means may be found in my aforesaid patents as well as my U.S. Pat. No. 4,034,968, the descriptions of which are incorporated herein by reference. This same type of feed means may also be used for the introducing of composition at the drum end 10. However, other means for feeding composition to the drum may also be incorporated such as that disclosed in U.S. Pat. No. 4,147,436, or any other suitable means.

A unique feature of the apparatus of the invention is in incorporating an intermediate product recovery means, in addition to the product recovery port 46 at or near the end of the apparatus in which burner 40 is located. At the intermediate drum recovery location, the drum may be provided with a plurality of ports 33 spaced around the drum exterior, and which ports may also be provided with covers, for example as disclosed in my U.S. Pat. No. 4,034,968. These ports cooperate with a collar or receptacle into which recovered composition is directed. The port covers may be hinged so that they close along a portion of the arc of drum rotation thereby further reducing the venting of hydrocarbon gases to atmosphere therethrough. The intermediate product recovery means shown also includes a port 36 in stationary annular collar 37 which extends around the drum exterior. The collar may also be provided with venting means for directing gases from within the drum, which contain asphalt hydrocarbon volatiles and dust, to a filtration or scrubbing apparatus, particularly where air pollution requirements dictate that such gases cannot be directly vented to atmosphere, but must first be cleaned to remove particulates and condensable hydrocarbon materials. In my U.S. Pat. No. 4,034,968 is also disclosed a means for directing hydrocarbon gases from such a collar to a burner for more complete combustion is shown and may also be utilized. Any suitable means for recovering the composition from the intermediate location may be utilized, and that shown is for the purpose of illustration only.

The important concept of the invention is that an intermediate product recovery port for recovering composition from the drum interior is located intermediate the drum ends and adjacent, but upstream, from the intermediate composition feed ports. Accordingly, product recovery port 36 is located between drum end 10 and the intermediate composition feed means, i.e., port 20. All, or a portion of composition introduced at drum end 10 may be recovered through the intermediate product recovery port 36. With such an intermediate recovery means, the drum of the invention is provided with two composition heating sections, section 18 comprising the length of the drum between the intermediate feed means at ports 20, and drum end 11, at which all the composition fed into the intermediate feed ports is recovered. In first drum section 18, the composition introduced at the intermediate feed means is gradually heated as it is alternately lifted and dropped in section 18 of the drum. Of course, the composition is gradually drawn because of the tilt of the drum from the intermediate input means to the product recovery port 46. In the second section 28 of the drum, located between drum end 10 and intermediate product recovery ports 33 or 36, composition introduced in chute 16 is also alternately lifted and dropped forming a curtain of composition particles which composition is gradually heated as it is drawn toward the intermediate product recovery ports. Preferably all of the composition introduced in chute 16 is recovered at product recovery port 36.

The aforesaid disclosed apparatus is particularly useful in recycling asphaltic concrete in which a portion of the final recycle composition includes an amount of virgin aggregate. Although recycling of a composition containing 100% recycled material in an elongated drum as disclosed in my U.S. Pat. No. 3,999,743 is desirable for certain operations, for others, a mixture of reclaimed asphaltic concrete and virgin aggregate is used in the final recycle mix, as disclosed in my aforesaid U.S. Pat. No. 4,177,080. Accordingly, operating such a process with the apparatus of the present invention, reclaimed asphaltic concrete particles 25 are introduced into the drum at drum end 10, opposite burner 40, which particles are gradually heated as they are directed through hot gases of combustion in section 28 of the drum upstream from intermediate feed ports 20. Virgin aggregate 35 is supplied to the drum via intermediate feed ports 20 whereby that material becomes heated in drum section 18, between the intermediate feed ports and product recovery port 46. Since burner 40 supplies flame and hot gases of combustion at drum end 11 and directs the hot gases toward opposite drum end 10, the average temperature in drum section 18 is substantially hotter than that in section 28. It is understood that in recycling asphaltic concrete, burning of the asphalt in the reclaimed material is to be avoided, not only to prevent noxious or undesirable asphalt combustion products, but to reduce or obviate asphalt degradation. It is normally desirable to heat the reclaimed asphaltic concrete to temperatures between about 200° and about 325° F. or so, preferably above about 225°. On the other hand, aggregate material, which contains no asphalt composition, may be heated to substantially higher temperatures, desirably up to 600° F. or more. By being able to super-heat the aggregate particles, say between 400° and 800° F., the final temperature at which the reclaimed asphaltic concrete is to be heated in the drum is not so critical, since it will be mixed with the super-heated aggregate later on, whereby the overall final recycle mix temperature will be suitably in the 225°-325° range, preferably between about 250° and 325° F. Even higher temperatures may be achieved for certain uses, so long as substantial asphalt degradation does not occur.

In processing the compositions in the apparatus of the invention, the non-asphalt containing aggregate being heated in section 18 of the drum forms a curtain of particles which acts to shield section 28 of the drum from the extremely hot temperatures otherwise caused from the flame and hot gases of combustion of burner 40. Because the temperatures in drum section 28 are lower than in section 18, asphalt burning which might otherwise occur is substantially reduced, if not eliminated. This is particularly critical where the reclaimed asphaltic concrete includes a substantial amount of fines, extremely high in asphalt content and susceptible to burning or degradation in temperatures above about 800° F. Thus, in the apparatus of the invention, all of the reclaimed asphaltic concrete can be heated in section 28 of the drum and recovered at intermediate recovery means, port 36, without being exposed to the extremely high temperatures, particularly near or toward drum end 11 in section 18. Accordingly, the reclaimed asphaltic concrete can be treated in one section of the drum, and recovered intermediate the drum ends, while virgin aggregate can be introduced at an intermediate feed means, and heated to any desirable extent and recovered from the hotter section 18 of the drum. The heated asphaltic concrete 59 recovered at intermediate recovery port 36 may be directed to any suitable mixing apparatus via conveyor 60, while the hot aggregate recovered at port 46 is directed to the mixing apparatus, pugmill, or the like via conveyor 38. Any desirable amounts of these respective materials may then be mixed to achieve the desired final recycle mix. Make up asphalt may be added in section 28 via pipe 58, or during final mixing.

In another embodiment of the invention a selected portion of the heated aggregate recovered from port 46 may be diverted and returned to the drum for further heating. Specifically, means for diverting any or all of the aggregate recovered from port 46, such as a flap gate 52 having diverter plates 48 and 50 may be utilized. Such a device allows selected amounts of the aggregate to pass to conveyors 38 and/or 54. The portion of aggregate 55 diverted to conveyor 54 is returned to the drum via port 20. It may be fed to conveyor 32, or directly to hopper 34 and rerun through the hot zone of the drum, first section 18 thereby becoming heated to even higher temperatures. Continuing to divert a portion of the recovered aggregate back to the drum allows an operator to continue to elevate the average temperature of aggregate recovered at port 46. By carefully selecting the amount or percentage of aggregate to be diverted to conveyor 54 and returned to the drum for rerun and additional heating, substantial control of the specific temperature of the heated or super-heated aggregate recovered is provided. The greater the amount of aggregate returned and rerun through the drum, the greater the recovered aggregate temperature, up to the practical limits of the apparatus. Another advantage of returning a portion of the recovered aggregate to input port 20 is in more easily achieving and maintaining the desired density of the veil or curtain of aggregate particles in drum section 18, and, as a result, control of the temperature in second drum section 28.

Although a flap gate diverter 52 is shown by way of example, together with return conveyor 54, any suitable means for diverting selected amounts of aggregate recovered through port 46 may be used. An alternative diverter means may incorporate a plurality of gates, which may be opened or closed in response to operator selected control means. Such means may include electronic selection and servo equipment for automating the diverting apparatus, or it may be accomplished by hand operated means. Moreover, any suitable means for moving or conveying the aggregate back to intermediate feed port 20 may be used.

In still another embodiment of the invention, a selected portion of the aggregate recovered at port 46, or at drum end 11 may be diverted to drum end 10 and fed into chute 16 with the reclaimed asphaltic concrete 25 also being introduced therein. Conveyor 56 or other suitable means for conveying a portion of the heated aggregate from the opposite drum end may be used. The portion of aggregate conveyed to drum end 10 may be a third portion of aggregate recovered from port 46, or it may be a portion of aggregate 55 diverted to conveyor 54, or, it may be any portion, or all of aggregate 44 directed to conveyor 38. Thus, for example, drum section 28 may be used for the final mixing of hot aggregate, previously heated in drum section 18, and reclaimed asphaltic concrete. In that event, all of the hot recovered aggregate from port 46 not diverted for further heating via conveyor 54, will be directed to drum end 10 for introduction into section 28, for example, via chute 16. Alternatively, it may be desirable to divert only a portion of the hot aggregate to drum end 10 for mixing with the reclaimed material in drum section 28. Mixed asphaltic concrete and aggregate composition so recovered at port 36 may then be further mixed with additional hot aggregate in another mixing apparatus, not shown.

Any conveying means for directing hot aggregate to drum end 10 may be used, and conveyor 56 is by way of illustration only. The aggregate 57 may be directed to a common conveyor 26 with the asphaltic concrete, or introduced separately into chute 16 or through another separate port into drum section 28. For example, another trough, scoop and hopper system, like that shown for the intermediate feed, may be used adjacent drum end 10. Make-up asphalt, alone, or with a softening agent as disclosed in my U.S. Pat. No. Re. 30,685 and U.S. Pat. No. 4,256,506 may also be introduced, pipe 58 being shown for that purpose. Utilizing this embodiment, it is evident that the use of additional mixing apparatus, for mixing hot aggregate from recovery port 46 and heated asphaltic concrete from port 36, may not be required, and all of the mixing may be accomplished in the apparatus shown, with the final recycle mix product recovered from port 36. Of course, such a process will require the operator to measure or weigh the different portions of aggregate to be diverted, all of which may be accomplished in a continuous process. Thus, a portion of aggregate may be continuously or intermittently supplied from port 46 and reintroduced into drum section 18, while a portion of the aggregate having the desired final temperature may be recovered on conveyor 38 and directed to drum end 10, via conveyor 56 for mixture with reclaimed asphaltic concrete. To this mixing composition may be added the appropriate amount of asphalt and, if desired, softening agent, preferably aromatic, as described in my aforesaid patent, to achieve a desirable recycle mix at port 36.

Although not shown, it is within the purview of the invention described herein, to modify the apparatus to include yet a third drum section, having composition input and recovery ports, like those previously described. Such a third section would be between sections 28 and 18, whereby all or a portion of the asphaltic concrete recovered from port 36 and the hot aggregate finally recovered from port 46, and not to be rerun through section 18, would be directed to the intermediate section and mixed, make-up asphalt added, and the final recycle mix obtained. These advantages and modifications as well as others will be evident to those skilled in the art.

I claim:

1. A process for treating asphaltic concrete and aggregate comprising introducing hot gases of combustion in a first end of an elongated rotating drum, introducing non-asphalt containing virgin aggregate in a first section of said rotating drum intermediate said first end and a second opposite end of said drum, introducing used asphaltic concrete composition particles in a second section of said rotating drum at or adjacent said second end of said drum, gradually heating and advancing said asphaltic concrete along said second section of said drum toward said first end and recovering at least a portion thereof before said asphaltic concrete reaches said first section of said drum, and gradually heating and advancing said aggregate along said first section of said drum toward said first end and recovering said aggregate from said drum at or adjacent said first end.

2. The process of claim 1 including rotating said drum whereby said aggregate forms a curtain of particles in said first section of said drum to shield asphaltic concrete in said second portion of said drum.

3. The process of claim 1 wherein substantially all of said asphaltic concrete is recovered from said second section.

4. The process of claim 1 including returning at least a portion of heated aggregate recovered from said drum to said first section of said drum for being further heated prior to said mixing.

5. The process of claims 1, 3 or 4 wherein heated asphaltic concrete and heated aggregate recovered are mixed outside of said drum.

6. The process of claim 1 wherein said asphaltic concrete is heated to at least about 200° F. in said drum.

7. The process of claim 1 wherein said aggregate is heated to at least about 300° F. in said drum.

8. The process of claim 1 including adding liquid asphalt to said asphaltic concrete in said drum.

9. The process of claims 1 or 4 including conveying at least a portion of said heated aggregate recovered from said drum to said second section of said drum and mixing said heated aggregate with said used asphaltic concrete in said second section.

10. A process for treating asphaltic concrete and aggregate comprising:

introducing flame and hot gases of combustion into an elongated rotating drum at a first end thereof toward a second opposite end, introducing non-asphalt containing aggregate into a first section of said drum through a first imput port intermediate said drum ends, heating and advancing said aggregate along said drum to a first recovery port at or adjacent said first end, and recovering said heated aggregate, introducing asphaltic concrete particles into a second section of said drum through a second input port at or adjacent said second end, heating and advancing said asphaltic concrete along said drum to a second recovery port intermediate said first and second ends and before it reaches said first section, and recovering said heated asphaltic concrete at said second recovery port.

11. The process of claim 10 including adding asphalt to said asphaltic concrete in said second section.

12. The process of claim 10 including mixing said heated aggregate and said heated asphaltic concrete outside of said drum.

13. The process of claim 10 including diverting at least a portion of said heated aggregate from said first recovery port and directing said portion to said first input port and further heating said aggregate in said first section of said drum.

14. The process of claim 13 including mixing at least a portion of said heated aggregate recovered from said drum with said heated asphaltic concrete outside of said drum.

15. The process of claim 10 including diverting at least a portion of said heated aggregate from said first recovery port and directing said heated aggregate to said second input port and mixing said heated aggregate with said asphaltic concrete in said second section of said drum.

16. The process of claim 15 including recovering the mixture of said asphaltic concrete and said heated aggregate from said second recovery port.

17. The process of claim 15 including diverting a portion of said heated aggregate from said first recovery port and directing said portion to said first input port and further heating said aggregate in said first section of said drum.

18. The process of claims 15 or 17 including adding asphalt to the mixture of asphaltic concrete and aggregate in said second section.

19. The process of claim 1 including conveying at least a portion of heated aggregate recovered from said first section to said second section and introducing said heated aggregate at or adjacent said second end of said drum, gradually mixing said heated aggregate with said asphaltic concrete in said second section while advancing the mixture toward said first drum end, and recovering the mixture of aggregate and asphaltic concrete from said second section.

20. A process for recycling asphaltic concrete composition comprising introducing hot gases of combustion in a first end of an elongated rotating drum, introducing non-asphalt containing virgin aggregate in a first section of said rotating drum intermediate said first end and a second opposite end, gradually heating and advancing said aggregate along said first section of said drum toward said first end and recovering said aggregate from said drum adjacent said first end, introducing used asphaltic concrete composition particles and said recovered heated aggregate in a second section of said rotating drum adjacent said second end, and heating and mixing said asphaltic concrete and said heated aggregate in said second section of said drum and recovering the mixture before it reaches said first section of said drum.

21. A process for recycling asphaltic concrete comprising:

introducing flame and hot gases of combustion into an elongated rotating drum at a first end thereof toward a second opposite end, introducing non-asphalt containing aggregate into a first section of said drum through a first input port intermediate said drum ends, heating and advancing said aggregate along said drum to a first recovery port adjacent said first end, and recovering said heated aggregate, introducing asphaltic concrete particles and said heated aggregate into a second section of said drum through a second input port adjacent said second end, and mixing said asphaltic concrete and said heated aggregate and advancing the mixture along said drum to a second recovery port intermediate said first and second ends and recovering the mixture at said second recovery port before it reaches said first section.

* * * * *